US006948435B1

(12) United States Patent
Sheng

(10) Patent No.: US 6,948,435 B1
(45) Date of Patent: Sep. 27, 2005

(54) CORNER JOINT AND SHELF MODULE FOR USE IN LIGHT-DUTY ALL-PLASTIC SHELF UNITS

(75) Inventor: Tony L. Sheng, Kearny, NJ (US)

(73) Assignee: Honeyware, Inc., Kearny, NJ (US)

( * ) Notice: Subject to any disclaimer, the term of this patent is extended or adjusted under 35 U.S.C. 154(b) by 196 days.

(21) Appl. No.: 10/393,158

(22) Filed: Mar. 20, 2003

(51) Int. Cl.[7] ..... A47B 91/00
(52) U.S. Cl. ..... 108/192; 108/190; 108/180
(58) Field of Search ..... 108/64, 180, 190, 108/192, 193, 153.1, 106, 107, 110, 158.11; 211/186, 189, 134; 403/171, 172, 349; 312/257.1, 312/265.1

(56) References Cited

U.S. PATENT DOCUMENTS 3,851,601 A * 12/1974 Davis ..... 108/158.11
4,242,969 A * 1/1981 Checkwood et al. ... 108/158.11
4,275,666 A * 6/1981 Schriever ..... 108/101
4,474,416 A * 10/1984 Rogahn ..... 108/192
4,630,550 A * 12/1986 Weitzman ..... 108/180
4,989,519 A * 2/1991 Welsch et al. ..... 108/192
5,158,187 A * 10/1992 Taub ..... 211/186
5,218,914 A * 6/1993 Dickinson ..... 108/64
5,941,183 A * 8/1999 Ming-Shun ..... 108/153.1
6,062,150 A * 5/2000 Sikora et al. ..... 108/190
6,516,732 B1 * 2/2003 LaCombe et al. ..... 108/180

FOREIGN PATENT DOCUMENTS

GB 2241877 A * 9/1991 ..... A47B 96/06

* cited by examiner

*Primary Examiner*—Jose V. Chen

(57) ABSTRACT

An all-plastic light duty shelf unit includes rectangular shelf modules and vertical spacers. Each shelf module has four corner joints that can either be mated directly with each other or coupled together using cylindrical vertical spacers. This allows the user to customize the configuration of the shelf unit to meet his or her specific needs. It also reduces the cost to manufacture the shelf unit because the vertical spacers can be extruded rather than injection-molded. The corner joints also hold a shelf off the floor, thereby reducing part count and manufacturing cost.

6 Claims, 6 Drawing Sheets

CORNER JOINT AND SHELF MODULE FOR USE IN LIGHT-DUTY ALL-PLASTIC SHELF UNITS

BACKGROUND OF THE INVENTION

The invention relates to shelf units, and more particularly relates to light-duty shelf units. In its most immediate sense, the invention relates to inexpensive, light-duty all-plastic shelf units such as are sold in knocked-down form in mass market outlets.

Conventionally, a shelf unit of this type has a plurality of shelf modules. Each module has a joint at each corner. When the shelf unit is assembled, tubular vertical spacers must be fitted into corresponding joints of adjacent modules. As a result, a conventional shelf unit can only be assembled to form a vertical stack of shelves. This has little visual interest and does not allow the customer to customize the configuration of the shelf unit to meet his or her specific needs.

It would be advantageous to provide a shelf unit that would be more versatile and would have a more attractive appearance.

One object of the invention is to provide a shelf unit that would be more versatile and would also have a more attractive appearance.

Another object is, in general, to improve on known shelf units of this general type.

In accordance with the invention, a unitary all-plastic corner joint for a light-duty modular shelf unit is provided. The corner joint comprises a generally cylindrical housing having open top and bottom ends, a cylindrical central bore with a central stop region therein, an annular recess located inside the housing at the top end thereof concentric with and above the central bore, and an annular projection at the bottom end of the housing, the projection being dimensioned to mate with the recess.

With such a corner joint, shelf modules can either be interlocked directly (without using vertical spacers) or coupled together using vertical spacers. This makes it possible to build the shelf unit in customized and attractive configurations that meet the user's specific needs. Additionally, with such a corner joint, cost advantages are also brought about. This is because the vertical spacers that support the shelf modules in a stack can be cylindrical, and can be extruded rather than injection-molded. This substantially reduces the capital investment required to make the shelf unit.

In further accordance with the invention, a unitary all-plastic shelf module for a light-duty modular shelf unit is provided. The shelf module comprises at least one corner joint located at a corner and at least two peripheral pieces joined to the corner joint at the corner. Each joint has a generally cylindrical housing having open top and bottom ends located respectively above and below the peripheral pieces, a cylindrical central bore with a central stop region therein, an annular recess located inside the housing at the top end thereof concentric with and above the central bore, and an annular projection at the bottom end of the housing, the projection being dimensioned to mate with the recess. A shelf unit made from such a shelf module has the above identified advantages, and additionally has the advantage that each corner joint serves as a leg that supports the shelf unit above the floor, thereby making separate leg parts unnecessary and reducing manufacturing cost.

Although the shelf module can be of any shape (e.g. triangular, half-round, quarter-round), in accordance with the preferred embodiment the shelf module is rectangular. In such a case, there will be four peripheral pieces made up of two end pieces and two side pieces. If the shelf module is square, the end pieces and the side pieces will all be identical.

BRIEF DESCRIPTION OF THE DRAWINGS

The invention will be better understood with reference to the following illustrative and non-limiting drawings, in which.

DETAILED DESCRIPTION OF PREFERRED EMBODIMENTS

Figure 1:
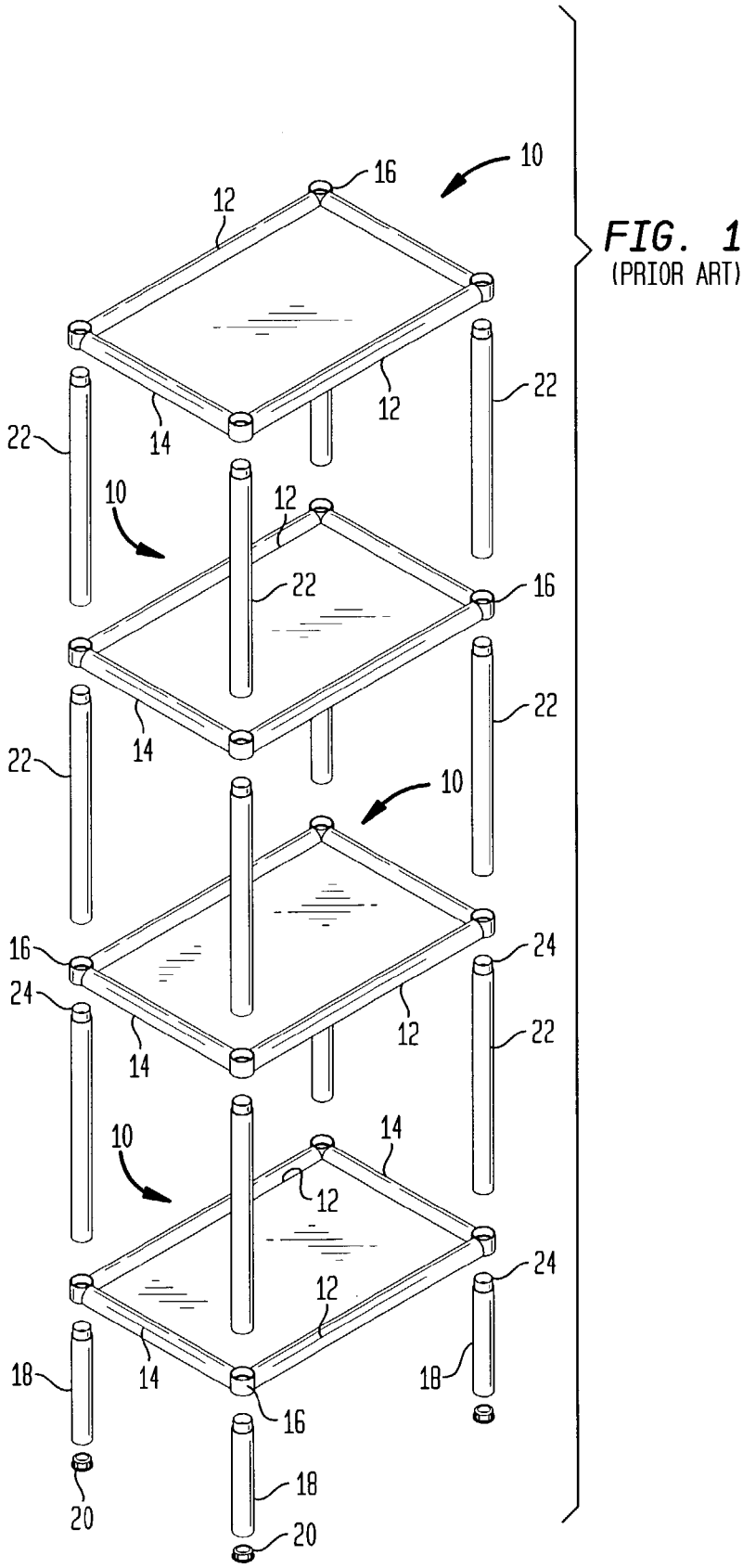
FIG. 1 (PRIOR ART)
FIG. 1 is an exploded view of a prior art shelf unit.

In the drawings, the same element is always indicated by the same reference numeral. The drawings are not necessarily to scale; portions may be enlarged for clarity.

In a known shelf unit illustrated in FIG. 1, rectangular all-polypropylene shelf modules 10 each have two side pieces 12 and two end pieces 14. At each corner of each shelf module is a corner joint 16.

The shelf unit is held off the floor by four polypropylene legs 18. Each leg 18 is a tube. To prevent the legs 18 from e.g. making annular depressions in carpeting, and to prevent foreign matter from entering them, the bottom end of each of the legs 18 is sealed off by a cap 20. The shelf modules 10 are supported in a vertical stack by vertical spacers 22. Each of the vertical spacers is a tube made of polypropylene, and each of the legs 18 and vertical spacers 22 has an annular recess 24 at its top end. The legs 18 and vertical spacers 22 differ only in their length; their top ends and bottom ends are identical.

Figure 2:
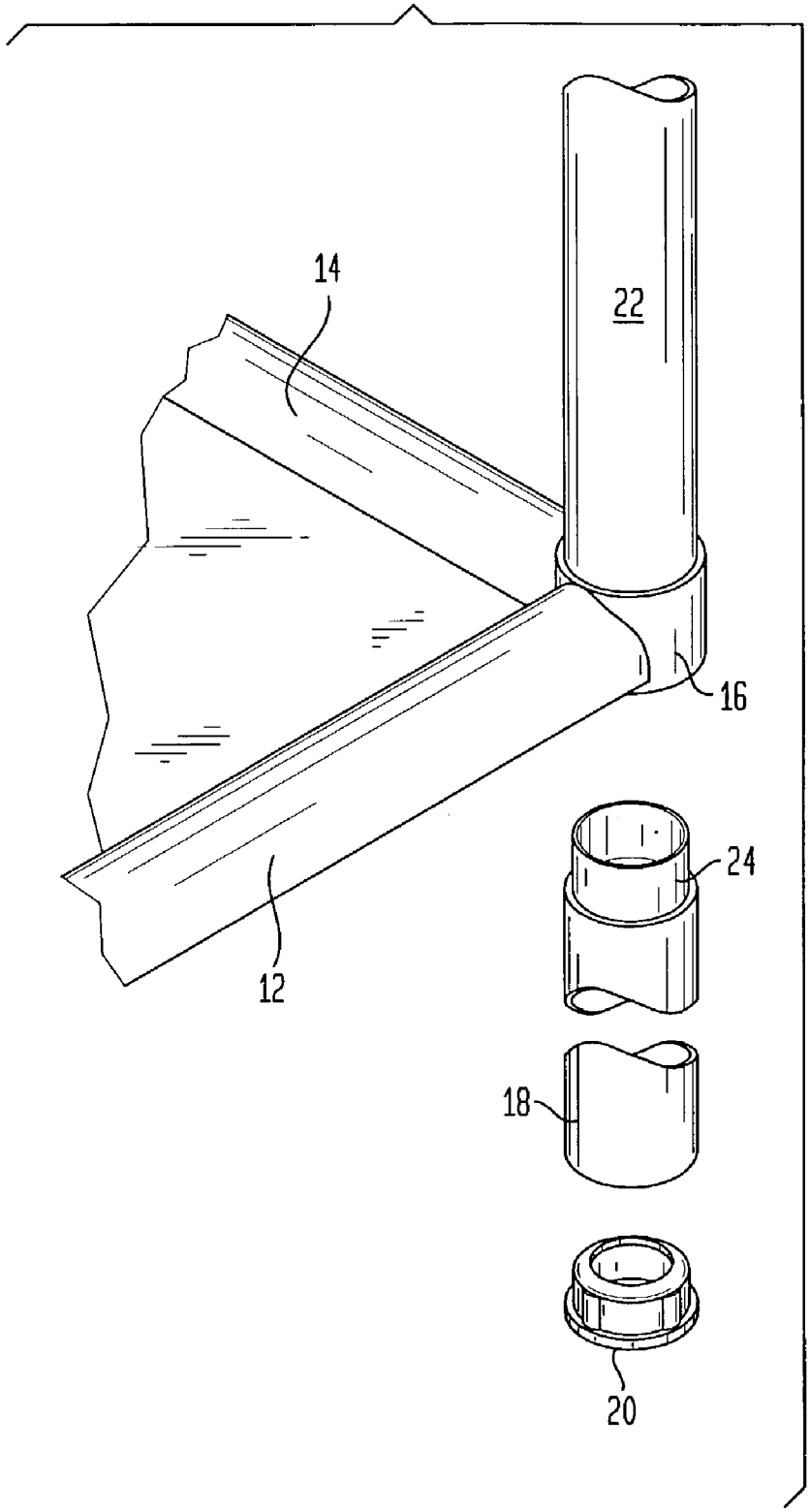
FIG. 2 (PRIOR ART)
FIG. 2 shows the corner joint and other parts of the prior art shelf unit.

FIG. 2 shows the relationship between a leg 18, the lower end of a spacer 22, and a corner joint 16. As can be seen there, the recess 24 is dimensioned so the top end of the leg 18 fits into the open bottom end of the corner joint 16, and the bottom end of the vertical spacer 22 fits into the open top end of the corner joint 16. Because the legs 18 and vertical spacers 22 have differently-shaped top and bottom ends dimensioned to mate only into the bottom and top ends respectively of the corner joints 16, it is impossible to assemble the shelf unit otherwise than in the illustrated vertical configuration.

This brings about the disadvantage that the shelf unit is visually uninteresting and cannot be assembled in a customized manner to meet the user's needs. Furthermore, because of the recesses 24, the legs 18 and 22 must be injection-molded. This requires the manufacturer to invest in a mold, which is a substantial capital cost. Additionally, the legs 18 and caps 20 are necessary to keep the lowest shelf module 10 off the floor. These components increase the part count and the cost of the shelf unit.

Figure 3:
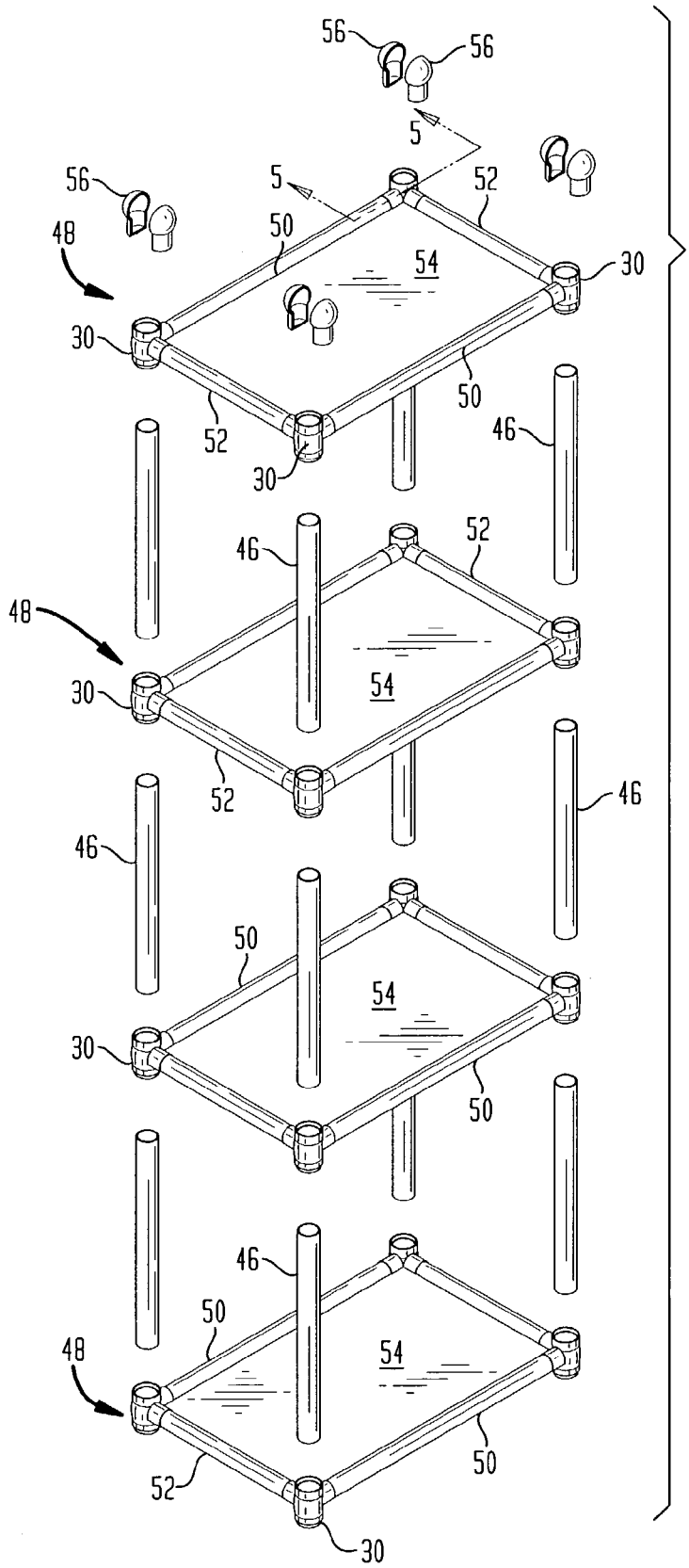
FIG. 3 is an exploded view of a preferred embodiment of the invention.
Figure 4:
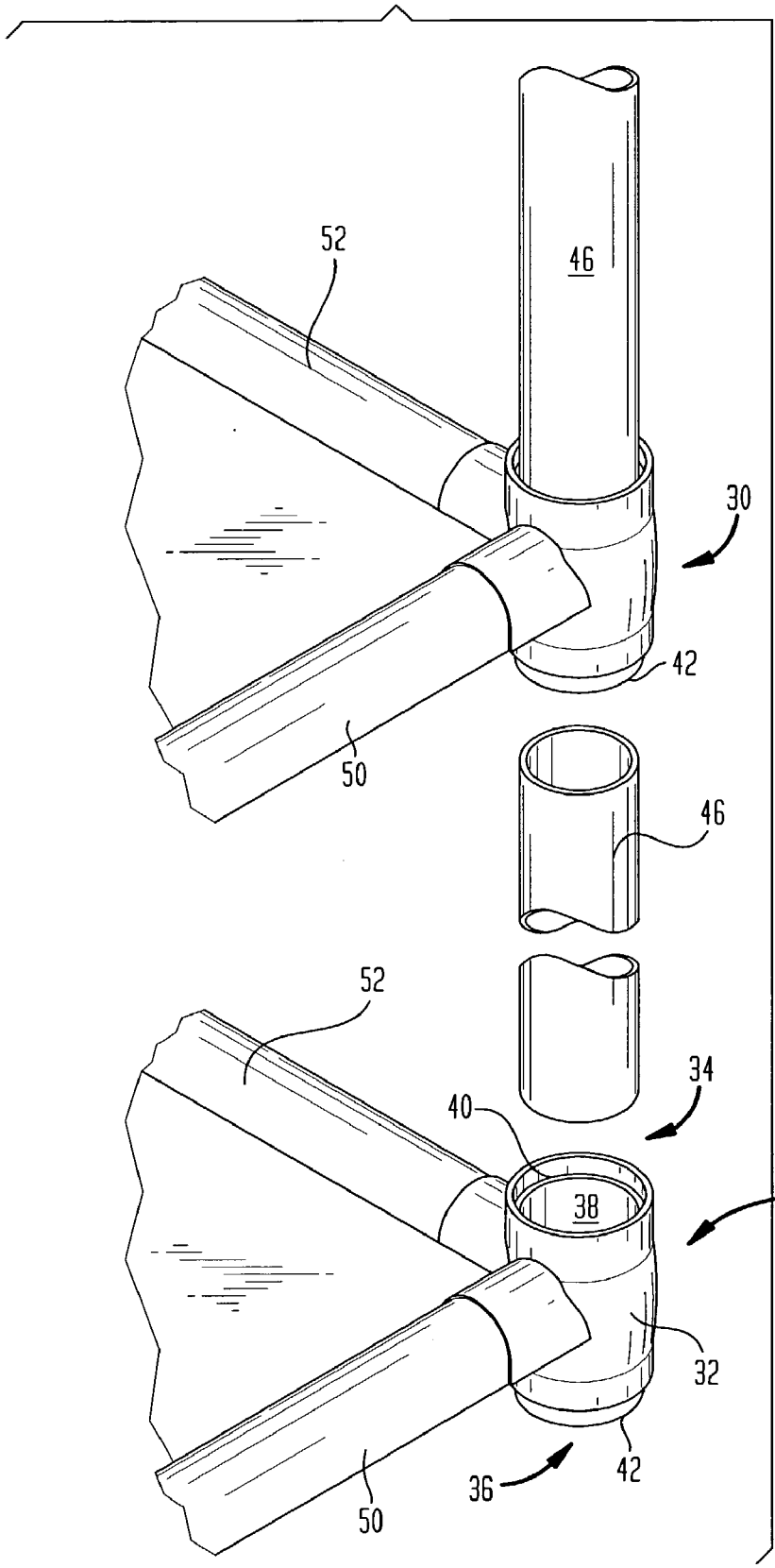
FIG. 4 shows two corner joints in accordance with a preferred embodiment of the invention, together with a tube that connects them.

Referring now to FIGS. 3 and 4, in accordance with a preferred embodiment of the invention, a corner joint 30 has a generally cylindrical housing 32 and also has open top and bottom ends 34 and 36 respectively. A central bore 38 extends through the corner joint 30. An annular recess 40 is located inside the housing 32 at the top end 34. The recess 40 is located above the central bore 38 and is concentric with it. An annular projection 42 is located at the bottom end 36, and is dimensioned to mate with the recess 40 of another corner joint 30 located immediately beneath it (FIG. 6). A central stop region 44 (FIG. 5), which in this example is an annular flange but could be a constriction of any shape, extends radially inwardly into the central bore 38.

Because (see FIG. 6) the projection 42 mates with the recess 40 of another corner joint 30, two corner joints 30 can if desired be fitted together without the need for an intervening vertical spacer 46 (although it is of course perfectly possible to couple them together using a vertical spacer 46 if desired). This permits the user to customize the configuration of the completed shelf unit to meet his or her specific requirements; the completed shelf unit can be configured vertically (see FIG. 3) or horizontally (see FIG. 7) or both, by combining components from two or more shelf units.

Additionally, it will be noted (FIG. 7) that the central bore 38 is cylindrical. As a result, in accordance with a preferred embodiment of the invention, the vertical spacer 46 can be a cylindrical tube. This is significant because cylindrical tubes can be extruded, and the cost of an extrusion die is negligible as compared with the cost of an injection mold.

In accordance with the preferred embodiment of the invention, a rectangular shelf module 48 is provided. Each shelf module 48 has two side pieces 50 and two end pieces 52, and a corner joint 30 is located at each of the four corners of the shelf module 48. In the center of each shelf module 48 is a flat shelf region 54 that is supported by the side pieces 50, the end pieces 52, and the corner joints 30.

Figure 6:
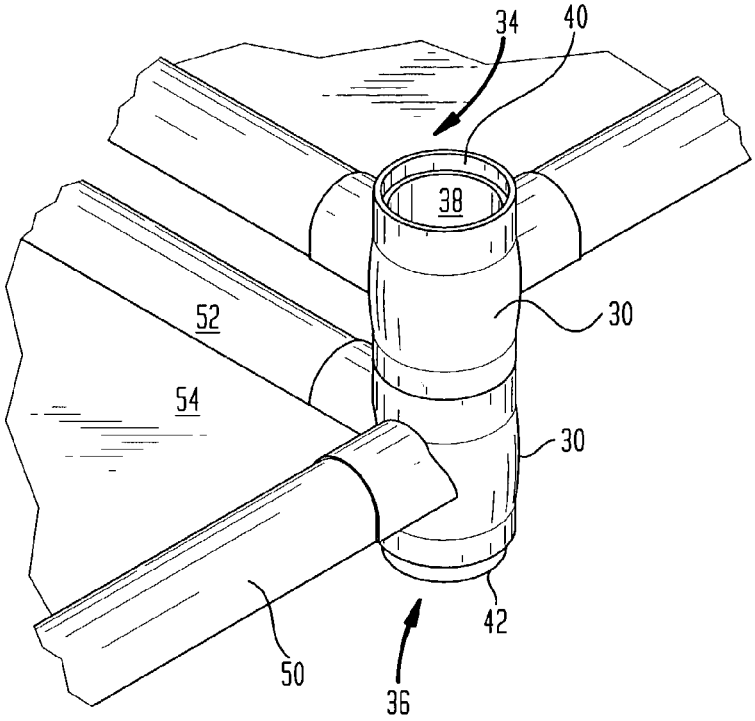
FIG. 6 shows two corner joints in accordance with a preferred embodiment of the invention, mounted together.
Figure 7:
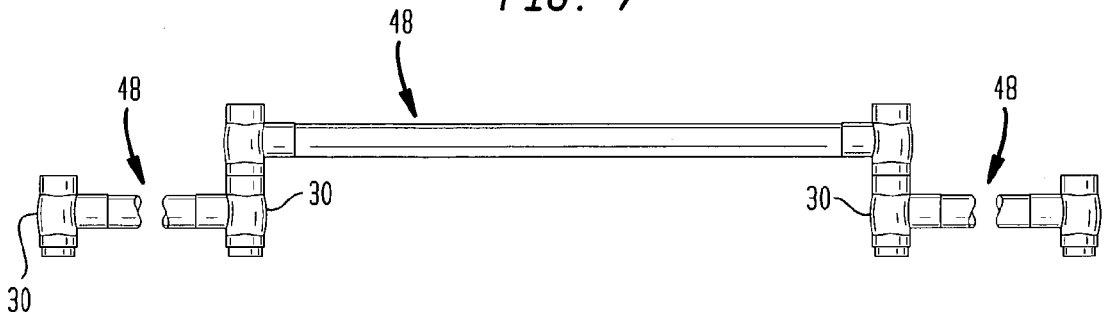
FIG. 7 shows a preferred embodiment of the invention configured horizontally.

As can best be seen in FIGS. 4, 6, and 7, the top end 34 and bottom end 36 of each corner joint 30 extend respectively above and below the side pieces 50 and end pieces 52. One consequence of this design is that (see FIG. 7) the bottom ends 36 of the corner joints 30 can support a shelf module 48 off the floor. Hence, no separate legs and caps (such as legs 18 and caps 20) are required, which reduces costs.

Although in accordance with the preferred embodiment the shelf module 48 is rectangular, it need not be an elongated rectangle. The shelf module 48 can alternatively be square, in which case the side pieces 50 and the end pieces 52 will all be identical. Furthermore, the shelf module need not be rectangular. It can alternatively be of another shape, e.g. triangular, half-round, quarter round, etc.; the shape of the periphery of the shelf module can be arbitrarily selected. The shelf module need have only one corner joint 30 located at a corner thereof and two peripheral pieces joined to the corner joint at the corner. And, although in accordance with the preferred embodiment there will normally be four such corner joints 30, there is no limit to the number of corner joints 30 that can be used in a particular shelf module. Furthermore, differently shaped shelf modules can be used in a single shelf unit; there is no requirement that all the shelf modules in a single shelf unit be identical.

In preferred embodiments, the vertical spacers 46 are extruded from polypropylene. Likewise in preferred embodiments, the shelf modules 48 and joints 30 are unitary, and are injection-molded from polypropylene. In the preferred embodiment, the side pieces 50 and end pieces 52 provide rigidity for the shelf region 54, but this is not strictly necessary. If the shelf region 54 sufficiently reinforced and/or made sufficiently thick, the side pieces 50 and end pieces 54 can be eliminated and each shelf module can be made of a shelf region and four corner joints. Alternatively, if open-centered shelves are desired, the shelf region 54 can be eliminated and each shelf module can be made up of side pieces, end pieces, and corner joints.

Figure 5:
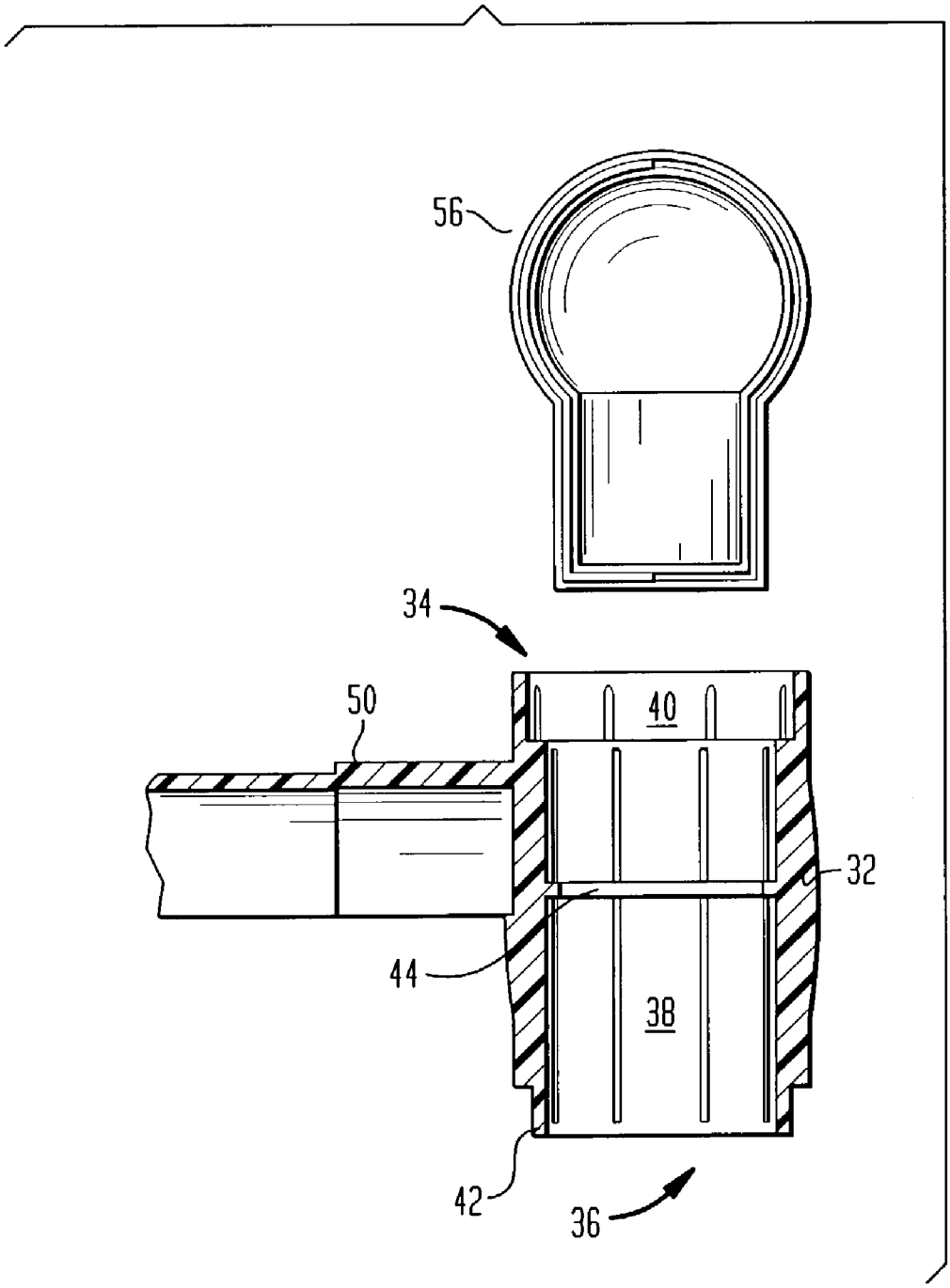
FIG. 5 shows a cross-sectional view of a corner joint and finial in accordance with a preferred embodiment of the invention.

In the preferred embodiment, each of the open top ends 34 of the highest shelf module 48 may be closed off by a finial formed of two identical mating halves 56 (shown in detail in FIG. 5). This improves the appearance of the assembled shelf unit, but is not necessary and is not a part of the invention.

Although at least one preferred embodiment of the invention has been described above, this description is not limiting and is only exemplary. The scope of the invention is defined only by the claims, which follow:

What is claimed is:

1. A unitary all-plastic corner joint for a light-duty modular shelf unit, comprising a generally cylindrical housing having open top and bottom ends, a cylindrical central bore with a central stop region therein, an annular recess located inside the housing at the top end thereof concentric with and above the central bore, and an annular projection at the bottom end of the housing, the projection being dimensioned to mate with the recess.

2. The corner joint of claim 1, wherein the plastic is polypropylene.

3. A unitary all-plastic shelf module for a light-duty modular shelf unit, comprising:

at least one all-plastic corner joint located at a corner, each joint having a generally cylindrical housing having open top and bottom ends located respectively above and below the peripheral pieces, a cylindrical central bore with a central stop region therein, an annular recess located inside the housing at the top end thereof concentric with and above the central bore, and an annular projection at the bottom end of the housing, the projection being dimensioned to mate with the recess; and at least two peripheral pieces joined to the corner joint at the corner.

4. The shelf module of claim 3, wherein there are four corner joints and four peripheral pieces made up of two end pieces and two side pieces, and wherein the shelf module is rectangular and has a corner joint at each corner.

5. The shelf module of claim 3, further comprising a central flat shelf region supported by the side pieces, end pieces, and corner joints.

6. The shelf module of claim 3, wherein the plastic is polypropylene.

* * * * *